US010155398B1

(12) United States Patent
Terrero et al.

(10) Patent No.: US 10,155,398 B1
(45) Date of Patent: Dec. 18, 2018

(54) SYSTEM AND METHOD FOR IDENTIFYING A LOCATION FOR PRINTING AN IMAGE ON AN OBJECT AND OPERATING PRINTHEADS TO PRINT THE IMAGE ON THE OBJECT

(71) Applicant: Xerox Corporation, Norwalk, CT (US)

(72) Inventors: Carlos M. Terrero, Ontario, NY (US); Roberto A. Irizarry, Rochester, NY (US); Jacob R. McCarthy, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/822,761

(22) Filed: Nov. 27, 2017

(51) Int. Cl.
*B41J 3/407* (2006.01)
*B41F 15/08* (2006.01)
*B41J 11/00* (2006.01)

(52) U.S. Cl.
CPC ..... *B41J 3/4073* (2013.01); *B41F 15/0895* (2013.01); *B41J 11/002* (2013.01)

(58) Field of Classification Search
CPC ..... B41J 3/4073; B41M 1/40
See application file for complete search history.

(56) References Cited

U.S. PATENT DOCUMENTS 6,238,039 B1 5/2001 Balakrishnan et al.
6,923,115 B1 8/2005 Litscher et al.
7,765,931 B2 8/2010 Kennedy, III et al.
8,511,782 B2 8/2013 Chang et al.
9,114,282 B2 8/2015 Kennedy, III
9,120,300 B2 9/2015 Moehringer et al.
9,217,090 B2 12/2015 Donohoe et al.
2002/0097280 A1 7/2002 Loper et al.
2002/0134257 A1 9/2002 Stephenson
2002/0191036 A1 12/2002 Park
2005/0178279 A1 8/2005 Valls
2005/0179721 A1 8/2005 Jones et al.
2006/0051518 A1* 3/2006 Persson ..... B05B 5/088 427/458
2009/0256897 A1 10/2009 Polk et al.
2011/0012952 A1 1/2011 Chang et al.
2015/0138295 A1* 5/2015 Lindner ..... B41J 3/4073 347/110
2015/0158310 A1 6/2015 Olejniczak et al.
2015/0224765 A1 8/2015 Fukasawa
2015/0273864 A1 10/2015 Moehringer et al.

* cited by examiner

*Primary Examiner* — Julian D Huffman
(74) *Attorney, Agent, or Firm* — Maginot Moore & Beck LLP

(57) ABSTRACT

A direct-to-object printer includes an image projector that projects an image on an object secured in a holder before the holder and the object pass a plurality of printheads for printing an ink image on the object. A camera generates a sequence of images of the projected image on the object to enable an operator to select a position on the object for the printing of the image and to identify distortion in the image through a user interface so a controller can modify operation of the printheads to attenuate the distortion in the image printed on the object.

16 Claims, 9 Drawing Sheets

SYSTEM AND METHOD FOR IDENTIFYING A LOCATION FOR PRINTING AN IMAGE ON AN OBJECT AND OPERATING PRINTHEADS TO PRINT THE IMAGE ON THE OBJECT

TECHNICAL FIELD

This disclosure relates generally to a system for printing on three-dimensional (3D) objects, and more particularly, to systems that print images on objects in non-production environments.

BACKGROUND

Commercial article printing typically occurs during the production of the article. For example, ball skins are printed with patterns or logos prior to the ball being completed and inflated. Consequently, a non-production establishment, such as a distribution site or retail store, for example, in a region in which potential product customers support multiple professional or collegiate teams, needs to keep an inventory of products bearing the logos of various teams followed in the area. Ordering the correct number of products for each different logo to maintain the inventory can be problematic.

One way to address these issues in non-production outlets would be to keep unprinted versions of the products and print the patterns or logos on them at the distribution site or retail store. Printers known as direct-to-object (DTO) printers have been developed for printing individual objects. Operating these printers with known printing techniques, such as two-dimensional (2D) media printing technology, to apply image content onto three-dimensional objects produces mixed results. As long as the surface of the objects are relatively flat, the images are acceptable. However, many products, such as mugs, water bottles, pens, and the like, have curved surfaces, which can adversely impact the printed image quality.

Challenges associated with direct-to-object printing include ejecting ink drops across large and varying gaps, locating the object and the position for the image on the object, registering the image onto the object, and holding and orienting the object for printing, for example. Given the multitude of object shapes and sizes that can be printed on, developing robust ways to hold a part and accurately determine where the faces of the printheads are relative to the surface to be printed is difficult. In other words, accurately determining the correct distance and orientation of the printheads with reference to an object surface as well as identifying the appropriate ejectors in a printhead to fire to center the image on the object is no trivial task.

These issues are exacerbated by objects that do not have a defined edge that can be used as a reference point to register an image and time the operation of the ejectors. Object holders may not present the part at an orientation that best matches the image and the area on the object selected for printing of the image may be irregular and cause distortion of the printed image. Therefore, a printing process control system that produces quality images for a wide variety of products having varying degrees of surface undulation and features would be beneficial.

SUMMARY

A new direct-to-object (DTO) printing system enables registration of an image with an area of an object prior to the printing of the object. The system includes a plurality of printheads, each printhead in the plurality of printheads being configured to eject marking material, a member having a first end and a second end, the plurality of printheads being positioned opposite the member and between the first end and the second end of the member, a holder configured to hold an object and to move along the member between the first end and the second end of the member, a first actuator operatively connected to the holder to enable the actuator to move the holder along the member to enable the object to move past the printheads to receive marking material from the printheads in the plurality of printheads, a second actuator operatively connected to the holder to enable the actuator to move the holder perpendicular to and in a plane parallel to the member, an imaging device positioned between the first end of the member and the plurality of printheads, the imaging device being configured to generate a sequence of images of a portion of the object opposite the imaging device, an image projector positioned between the first end of the member and the plurality of printheads, the image projector being configured to place an image on the portion of the object opposite the imaging device, a user interface operatively connected to the imaging device to receive the sequence of images from the imaging device, the user interface being configured to enable an operator to operate the first actuator and the second actuator to adjust a position of the object in an X-Y plane opposite the imaging device, and a controller operatively connected to the plurality of printheads, the first actuator, the second actuator, the imaging device, the image projector, and the user interface. The controller is configured to operate the first actuator to move the holder and object along the member between the first and second ends of the member, to operate the image projector to form an image on the portion of the object, to operate the imaging device to generate the sequence of images of the image on the object, to receive a signal from the user interface indicating the position of the object for a printed image has been selected for printing, to receive data from the user interface identifying a distortion of the image on the object, and to operate ejectors within the printheads of the plurality of printheads with reference to the data identifying the distortion of the image from the image projector to form an image with colorant on the object.

A method of operating a DTO printer enables registration of an image with an area of an object prior to the printing of the object. The method includes operating with a controller a first actuator operatively connected to a holder to move the holder and an object secured in the holder along a member to which the holder is mounted, operating with the controller an imaging device to generate a sequence of images of the object in response to the object being opposite the imaging device, displaying the sequence of images at a user interface, operating with the user interface the first actuator to adjust a position of the object along a Y axis and operating with the user interface a second actuator to adjust a position of the object along a X-axis, generating with the user interface a signal indicating a location on the object for an image has been selected, operating with the controller an image projector to place the image on the object, generating with the user interface data for identifying a distortion of the image on the object, and operating with the controller ejectors within a plurality of printheads to form an image with colorants on the selected portion of the object with reference to the data identifying the distortion of the image while the controller is operating the first actuator to move the holder and the object past the plurality of printheads.

BRIEF DESCRIPTION OF THE DRAWINGS

The foregoing aspects and other features of a printing system that registers an image with a portion of an object's surface prior to printing are explained in the following description, taken in connection with the accompanying drawings.

DETAILED DESCRIPTION

Figure 1:
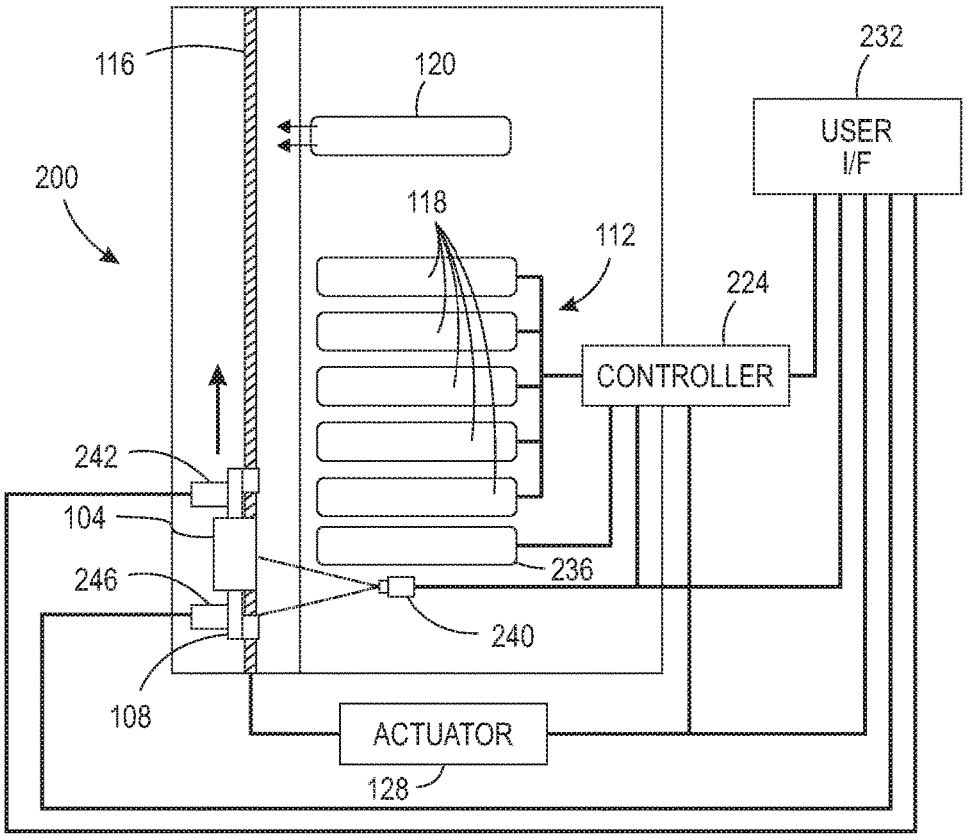
FIG. 1 is a schematic diagram of a side view of a printing system configured to register an image on a portion of the surface of an object holder and adjust the operation of the printheads in the printer to print the image on that portion of the surface.

For a general understanding of the present embodiments, reference is made to the drawings. In the drawings, like reference numerals have been used throughout to designate like elements.

Figure 6:
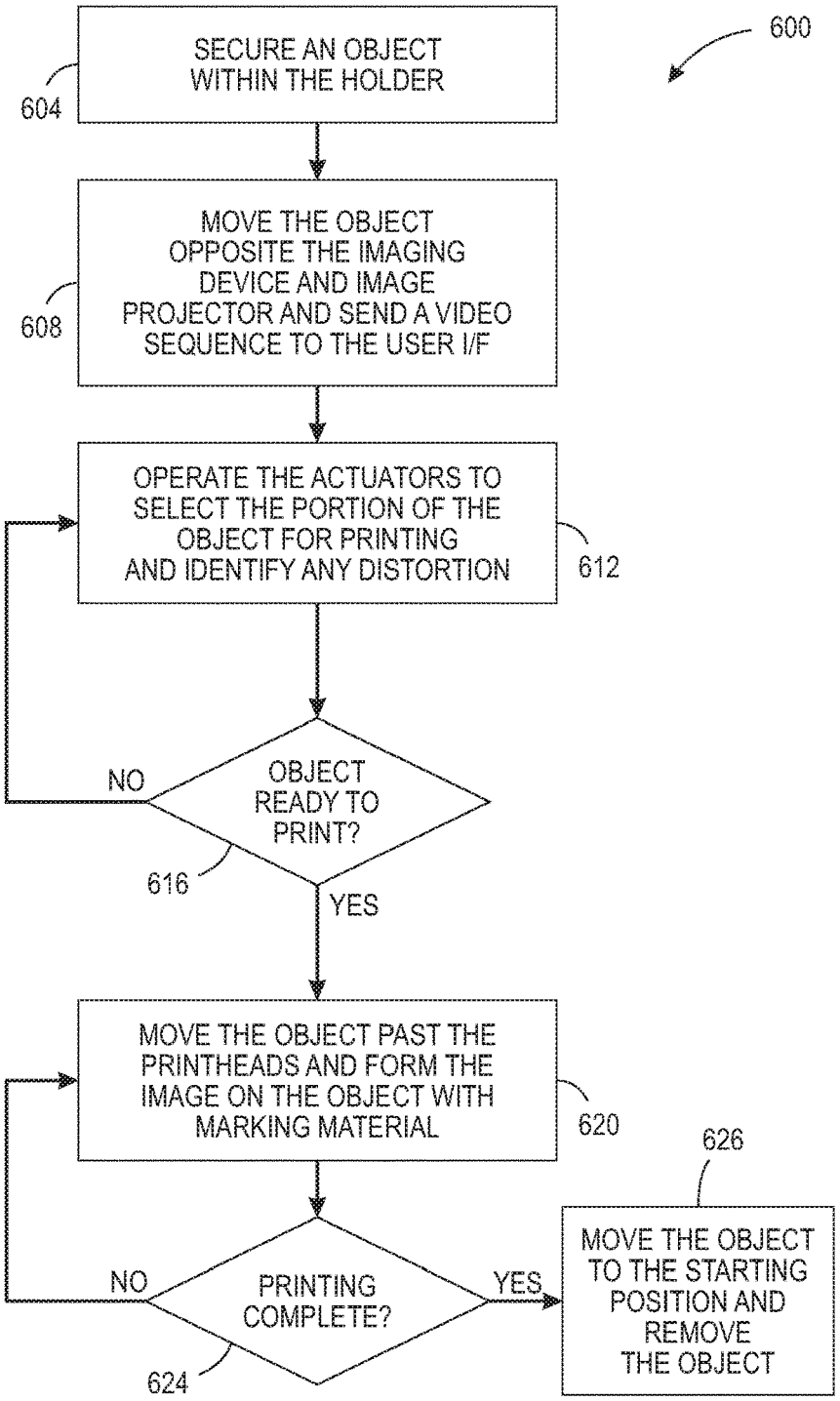
FIG. 6 is a flow diagram for a process that operates the system of FIG. 4.
Figure 7A:
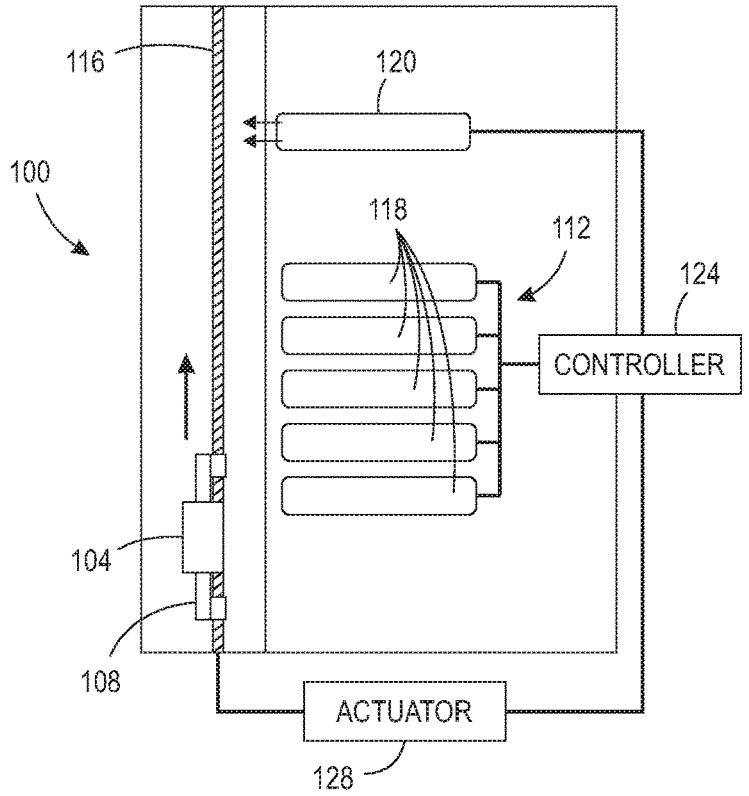
FIG.7A PRIOR ART
FIG. 7A illustrates an upright prior art printing system that feeds objects on an object holder past an array of fixed printheads and FIG. 7B depicts an object holder that can be used in the system of FIG. 7A.
Figure 7B:
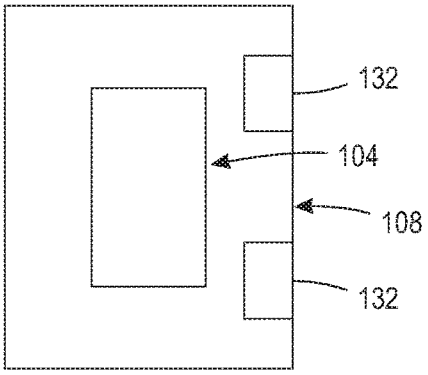
FIG. 7B PRIOR ART
Figure 8:
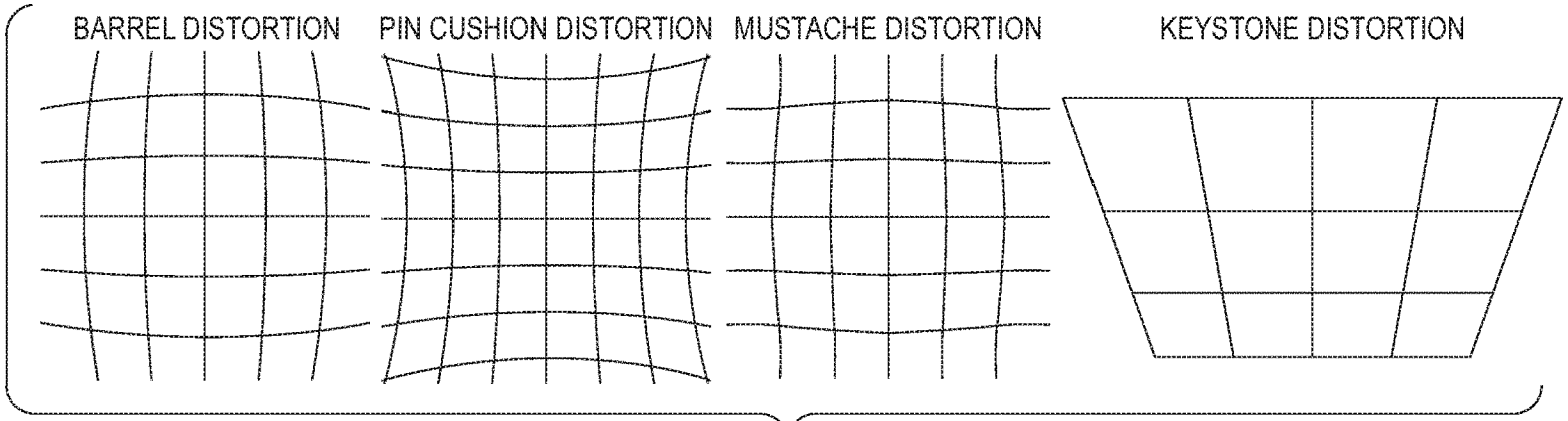
FIG. 8 illustrates known distortions in images printed by the system in FIG. 7.

FIG. 7 depicts a prior art printing system 100 configured to print the surface of an object 104 mounted to a holder 108 as the holder 108 moves on a member 116 past an array of fixed printheads 112. As used in this document, the term "fixed printhead" refers to printheads in a printer that have their faceplates remain parallel with the plane of the object holder throughout the printing of the object secured by the bolder. If one or more of the printheads 118 in the array 112 ejects ultraviolet (UV) ink, then the controller 124 operates the UV lamp 120 to cure the UV ink. The controller 124 is also configured to operate the actuator 128 to move the holder 108 after the object is mounted into the holder. Controller 124 is configured to operate the printheads 118 in the array 112 to eject marking material onto the surface of the object 104. FIG. 6B depicts the holder 108 and the object 104 as they face the printhead array 112. Latches 132 attach the holder 108 to the member 116. Possible image distortions that may arise from the use of the prior art printer 100 are illustrated in FIG. 8. These distortions are known as barrel distortion, pin cushion distortion, mustache distortion, and keystone distortion.

Figure 9A:
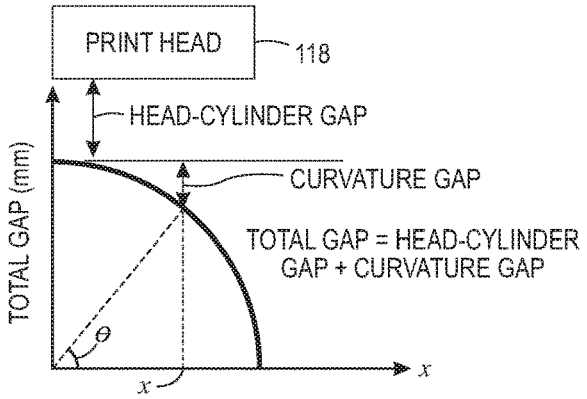
FIG. 9A PRIOR ART
FIG. 9A depicts the issue of increased distance between the printhead and the object as the curvature increases for an object in the prior art system of FIG. 7 and a graph illustrating this issue in FIG. 9B with an illustration of the resulting image distortion in FIG. 9C.
Figure 9B:
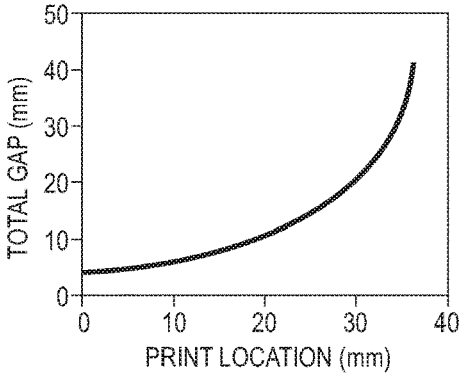
FIG. 9B PRIOR ART
Figure 9C:
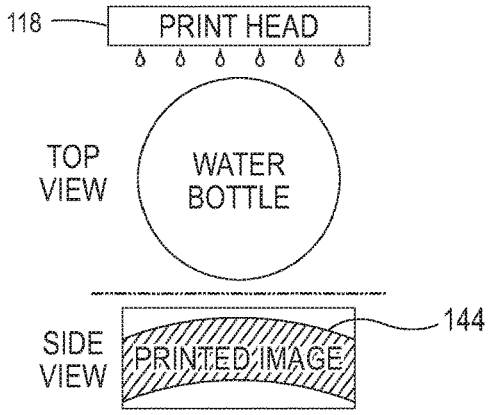
FIG. 9C PRIOR ART

Another problem arising in the prior art printer 100 is shown in FIG. 9A. This figure shows the distance between the printhead and the landing position of drops ejected by the printhead 118 is the sum of the gap between the printhead and the portion of the object closest to the printhead, which is denoted as the head-cylinder gap, and the gap from a tangent at the head-cylinder gap to the position on the curvature of the object, which is denoted the curvature gap. As shown in the figure, the head-cylinder gap remains constant, but the curvature gap increases as the surface of the object falls away from the printhead 118. The graph in FIG. 8B reveals that the distance between the printhead 118 and the landing position for a drop increases as the print location is further removed from the portion of the object closest to the printhead 118. This increase in the distance means a drop at the positions further from the portion of the object closest to the printhead travel further so the object has more time to move on the member 116. Thus, drops ejected at the same time do not form a straight line across the object, but rather formed a curved, distorted image as shown in FIG. 9C.

To address distortion in ink images printed onto the irregular surfaces of objects, the printer 200 shown in FIG. 1 has been developed. Printer 200 includes the fixed printheads 118 in the array 112, the UV lamp 120, the member 116, and the holder 108 for objects 104 as previously described. The printer 200 also includes a user interface 232, an image projector 236 and an imaging device 240. The image projector 236 projects an image to be printed onto a portion of the surface of the object in a manner described more fully below and the imaging device 240 generates a sequence of visual images of the image on the surface portion. The sequence of visual images are displayed on the user interface 232 so an operator can see what the image looks like on the object. Using adjustment controls on the user interface 232, the operator can operate actuator 128 to adjust the vertical or Y position of the object to shift the image being projected onto the surface. The printer 200 also includes another actuator 242, which is operatively connected to holder 108. Holder 108 is configured with a slide the actuator 242 to move the holder in the direction orthogonal to the Y direction that also lies in the same plane as the Y direction. This direction is denoted the X or horizontal direction in this document. Thus, the operator can adjust the position of the surface portion of the object in the X-Y plane that is parallel to the member 116 opposite the image projector 236 and the imaging device 240. Another actuator 246 is configured to rotate the object grippers in the holder 108 to rotate the object 104 about the Z axis, which extends between the plane of the printheads 118 and the imaging device 240 to the plane of the holder 108. The operator can operate this actuator through the user interface controls to adjust the location for the image further. Additionally, the operator can observe any distortion of the image on the object and enter data, such as a code, with the user interface that identifies the distortion as one of the distortions noted above with regard to FIG. 8. The controller 224 is configured to select the ejectors to operate for image printing and to adjust the ejection timing of ejectors in the printheads 118 with reference to the distortion identification data to attenuate the distortion detected by the operator. Once the operator has finished positioning the image on the object surface and has identified the distortion of the image, if any, the printer 200 is ready to move the holder 108 and the object 104 past the printheads 118 for printing.

Figure 2:
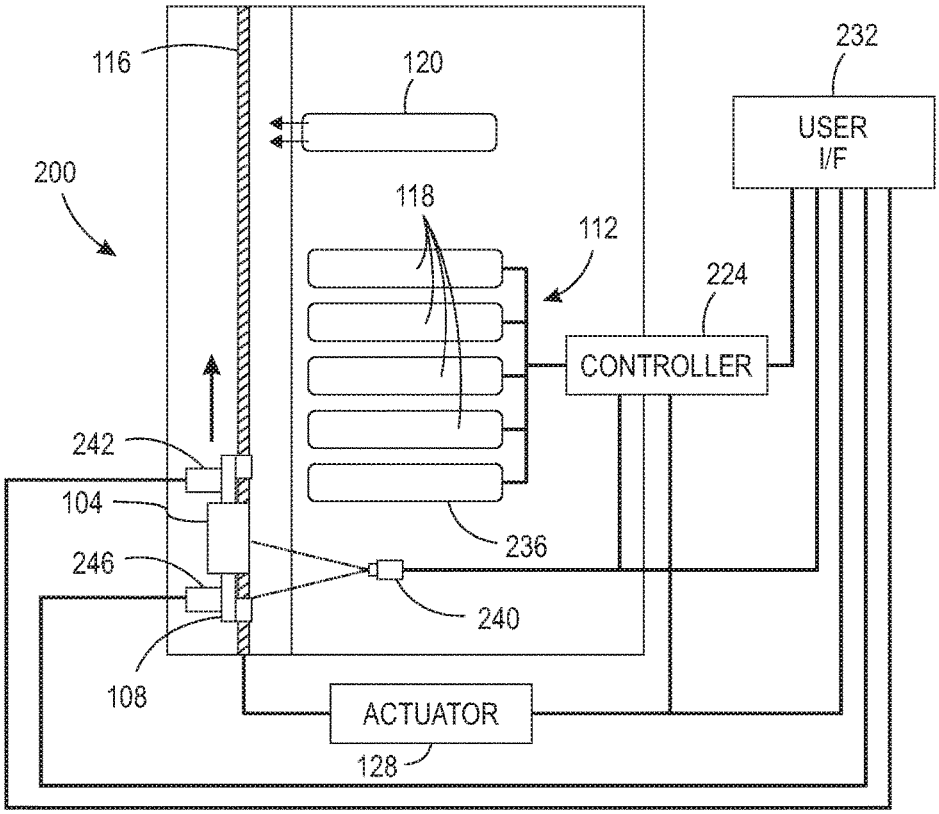
FIG. 2 depicts an embodiment of the system shown in FIG. 1 that uses one of the printheads as the image projector.
Figure 3:
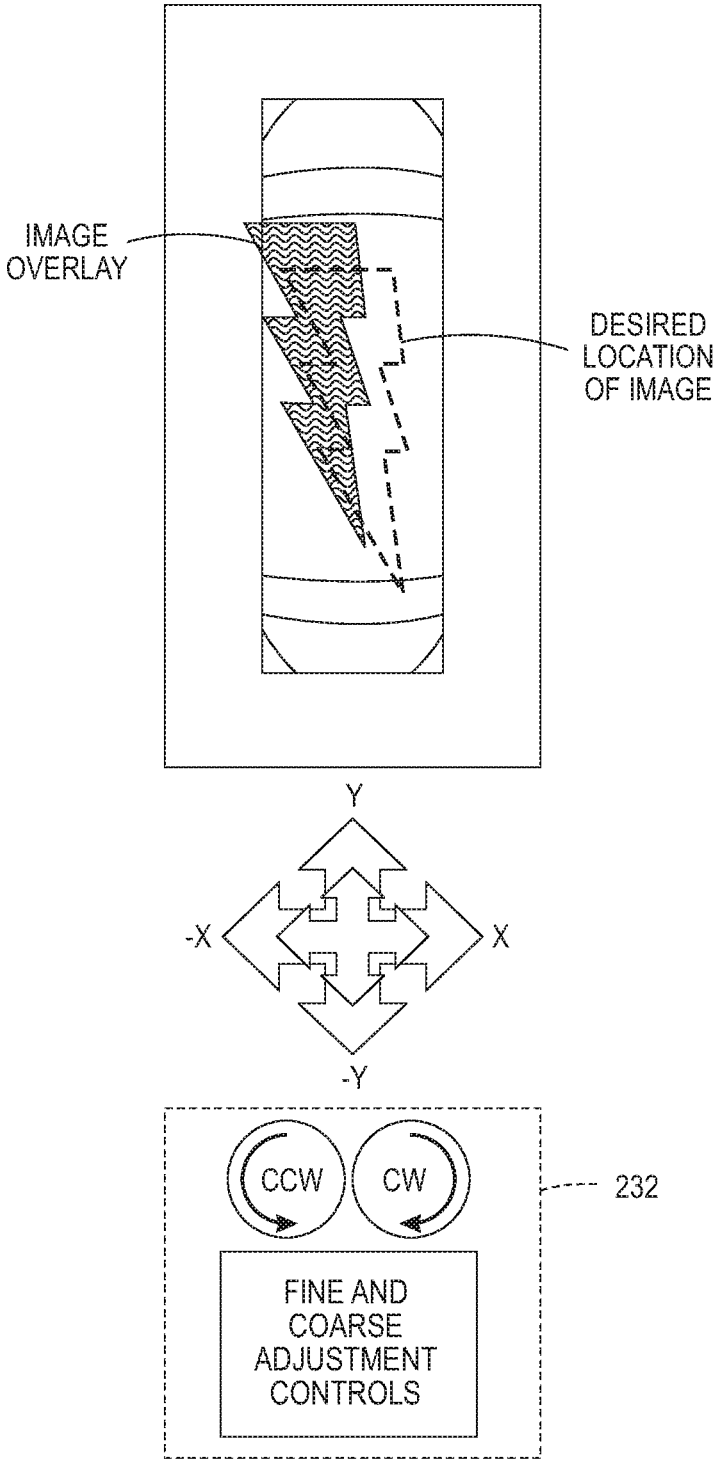
FIG. 3 depicts the use of the user interface to move the object and select a position on the object for printing.

In the printer 200' shown in FIG. 2, the lowest printhead in the printhead array is configured to eject ink that can only be viewed by an infrared imaging device. In this embodiment, the controller 224 operates the actuator 128 to position a portion of the object opposite the imaging device 240 so a sequence of images of the portion of the object surface can be sent to the display of the user interface and the operator can manipulate the actuators 128, 242, and 246 with the adjustment controls on the user interface as shown in FIG. 3 to position the object to an appropriate location for printing. Once the operator has selected the location for the image on the object, the controller 224 moves the holder 108 and the object 104 to a position opposite the infrared ink ejecting printhead and the printhead is operated to print an image on the object surface with the infrared ink. The printed image need not be a duplicate of the image to be printed on the object with colored marking material, although it could be. More frequently, however, the image would be a group of fiducials or some other appropriate test pattern that identifies the contours of the region to be printed and any distortions that may be caused by the undulations or protrusions of the region. The controller 224 then operates actuator 128 to return the holder 108 and the object 104 to a position opposite the imaging device 240. There, the infrared imaging device 240 generates a sequence of images of this printed image to the display of the user interface so the operator can determine whether the selected portion of the object surface can accommodate the image as well as enabling the operator to identify any distortions of the image. Once the distortion identification data, if any, has been entered, the controller 224 operates the actuator 128 to move the holder 108 and object 104 past the printheads 118 for printing in response to the operator generating a signal with the user interface that indicates the object is ready for printing.

Figure 4:
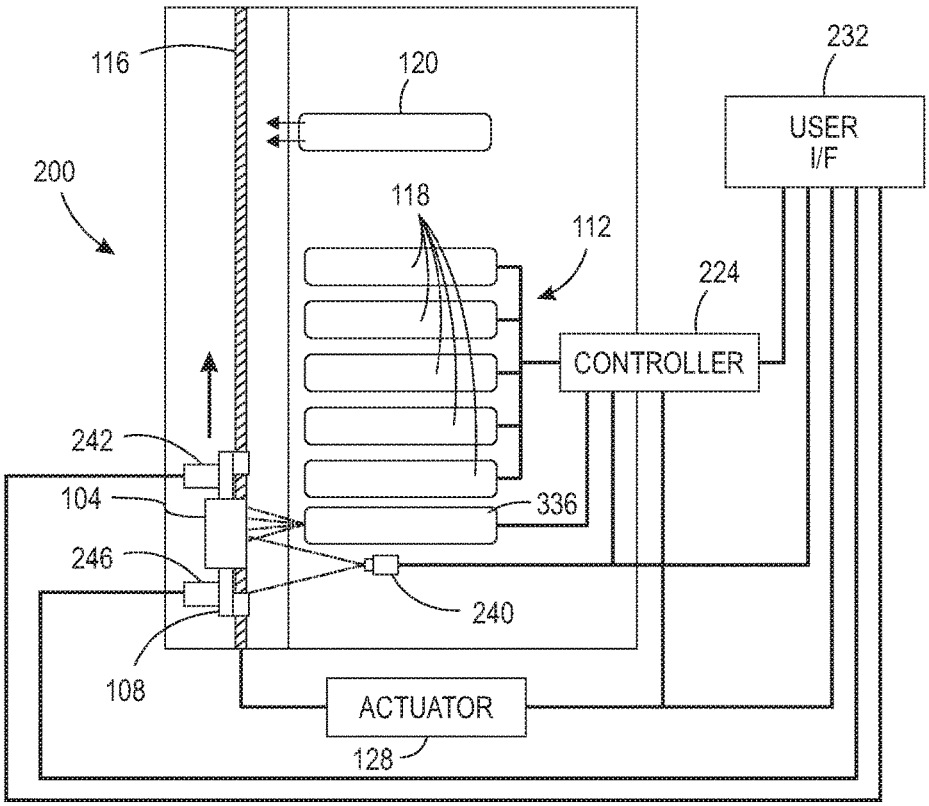
FIG. 4 depicts an embodiment of the system shown in FIG. 1 that uses a light projector for the image projector.

In the printer 200" shown in FIG. 4, the image projector 336 is a light image projector, which provides a light image on the surface of the object in the field of view of the imaging device 240. In this embodiment, the controller 224 operates the actuator 128 to position a portion of the object opposite the imaging device 240 so a sequence of images of the projected image on the portion of the object surface can be sent to the display of the user interface 232 and the operator can manipulate the actuators with the adjustment controls on the user interface as shown in FIG. 3 to position the object to an appropriate location for printing. Additionally, the operator can identify any distortions of the image in the image sequence being viewed. Once the distortion identification data, if any, has been entered, the controller 224 operates the actuator 128 to move the holder 108 and object 104 past the printheads 118 for printing in response to the operator generating a signal with the user interface that indicates the object is ready for printing. As was the case with the infrared ink embodiment, the light image need not be a duplicate of the image to be printed on the object, although it could be. More frequently, however, the image would be a group of fiducials or some other appropriate test pattern that identifies the contours of the region to be printed and any distortions that may be caused by the undulations or protrusions of the region. Because light does not drop over the gap between the projector and the object, firing signal adjustments are determined empirically and stored as calibration parameters in the printer or test pattern is printed on a substrate and analyzed by the controller to determine the ink drop droop from the ejectors in the printhead.

In the embodiments of FIG. 2 and FIG. 4, the imaging device 240 is illustrated as a camera 240 that is configured to generate video image data of an image on an object 104 in holder 108. Although a camera is shown in the figure, the imaging devices can be a plurality of light emitters and light detectors configured to direct light toward the object and receive reflected light so the detectors generate image data as electrical signals corresponding to the light intensity received by the detectors. As used in this document, "imaging device" means any device that is configured to generate one or more signals indicative of a portion of a surface of an object opposite the imaging device. In the figures, the camera is configured to capture color images at a frame rate of 30 frames/second or greater and each frame has a resolution of 1024 pixels by 1024 pixels. The video data is captured in a known format, such as avi or wmv and converted into image data files having a known format, such as PNG, jpeg, or the like. The image data are provided to the user interface 232 for display to enable the operator to verify the position for the image and to detect any distortions that may be present in the image.

Figure 5:
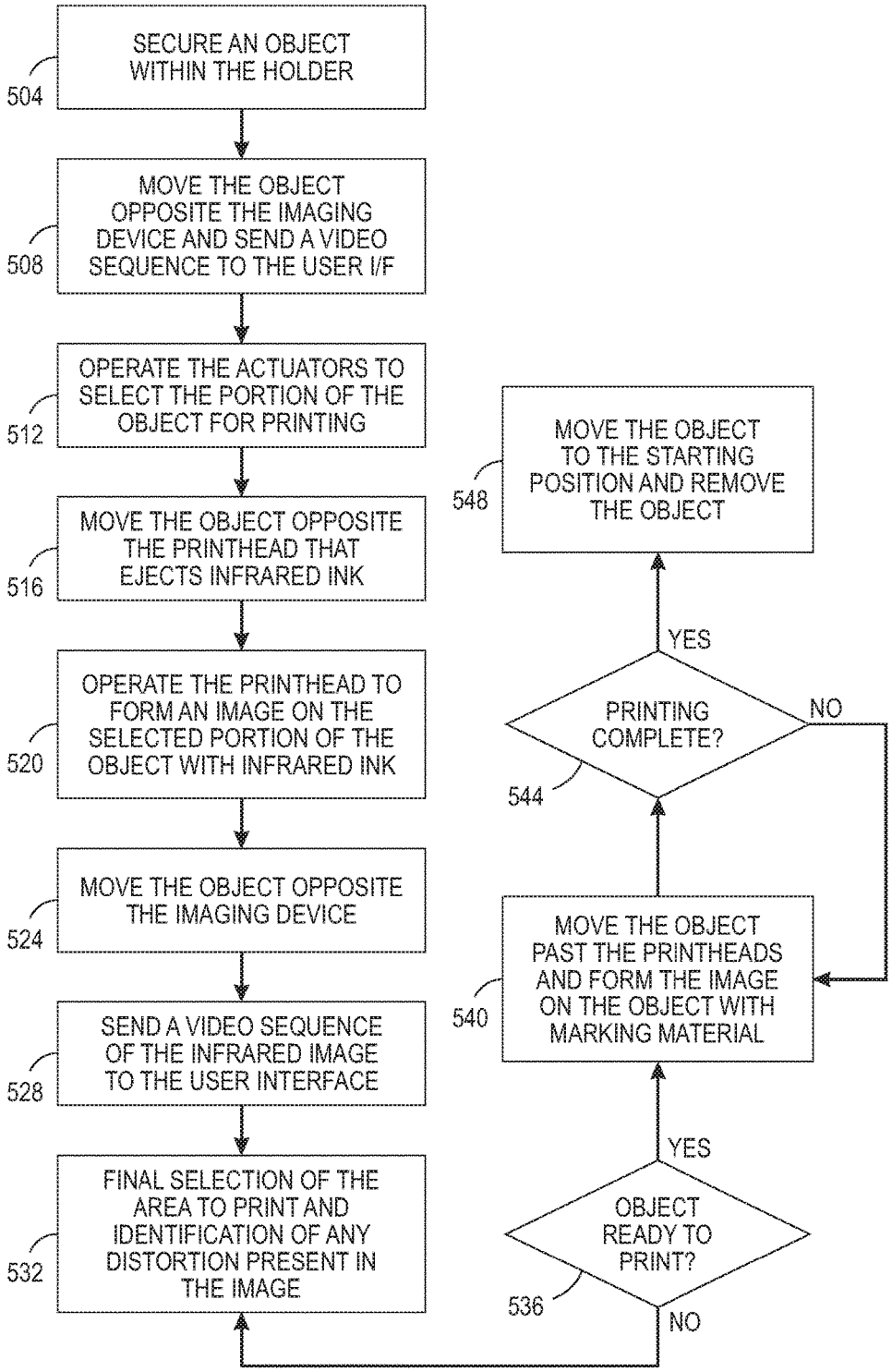
FIG. 5 is a flow diagram for a process that operates the system of FIG. 2.

A process 500 for operating the printer 200' is shown in FIG. 5 and a process 600 for operating the printer 200" is shown in FIG. 6. In the description of the processes, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 224 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

The process 500 begins with an object 104 being secured within the holder 108 (block 504). The controller operates the actuator 128 that is operatively connected to the holder 108 to move the object and the holder opposite the imaging device 240 and the controller operates the imaging device to generate a sequence of images of the object that the controller sends to the user interface (block 508). Using the position adjustment controls of the user interface, the operator translates the object in the X-Y plane and rotates the object about the Z axis to select the appropriate portion of the object for printing of an image (block 512). In response to a signal from the user interface that the image location has been selected, the controller 224 operates the actuator 128 to move the selected position on the object opposite the printhead 118 that ejects infrared ink (block 516). The printhead is operated by the controller to form an image on the selected portion of the object with the infrared ink (block 520). The controller 324 then operates the actuator 128 to return the holder 108 and the object 104 to the position opposite the imaging device 240 (block 524) and the imaging device is operated to generate a sequence of images of the infrared ink image on the object that are sent to the display of the user interface (block 528). The operator views the images to determine whether additional changes need to be made to the object's position and orientation and to enter an identification of an image distortion, if necessary (block 532). In response to the operator indicating the object is ready for printing (block 536), the controller 224 operates the actuator 128 to move the holder 108 and the object 104 past the printheads 118 that eject visible colorant onto the object to form the image (block 540). When the printing is finished (block 544), the controller 224 operates the actuator 128 to return the holder 108 and object 104 to the starting position where the object can be removed from the holder (block 548).

The process 600 begins with an object 104 being secured within the holder 108 (block 604). The controller operates the actuator 128 that is operatively connected to the holder 108 to move the object and the holder opposite the light projector 336 and the controller operates the light projector to project a light image on the object while the imaging device 240 generates a sequence of images of the object that the controller sends to the user interface (block 608). Using the position adjustment controls of the user interface, the operator translates the object in the X-Y plane and rotates the object about the Z axis to select the appropriate portion of the object for printing of an image and enters an identification code for any distortion observed (block 612). In response to the operator using the user interface to indicate the object is ready for printing (block 616), the controller 224 operates the actuator 128 to move the holder 108 and the object 104 past the printheads 118 that eject visible colorant onto the object to form the image (block 620). When the printing is finished (block 624), the controller 224 operates the actuator 128 to return the holder 108 and object 104 to the starting position where the object can be removed from the holder (block 628).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing system comprising:

a plurality of printheads, each printhead in the plurality of printheads being configured to eject marking material;

a member having a first end and a second end, the plurality of printheads being positioned opposite the member and between the first end and the second end of the member;

a holder configured to hold an object and to move along the member between the first end and the second end of the member;

a first actuator operatively connected to the holder to enable the actuator to move the holder along the member to enable the object to move past the printheads to receive marking material from the printheads in the plurality of printheads;

a second actuator operatively connected to the holder to enable the actuator to move the holder perpendicular to and in a plane parallel to the member;

an imaging device positioned between the first end of the member and the plurality of printheads, the imaging device being configured to generate a sequence of images of a portion of the object opposite the imaging device;

an image projector positioned between the first end of the member and the plurality of printheads, the image projector being configured to place an image on the portion of the object opposite the imaging device;

a user interface operatively connected to the imaging device to receive the sequence of images from the imaging device, the user interface being configured to enable an operator to operate the first actuator and the second actuator to adjust a position of the object in an X-Y plane opposite the imaging device; and a controller operatively connected to the plurality of printheads, the first actuator, the second actuator, the imaging device, the image projector, and the user interface, the controller being configured to operate the first actuator to move the holder and object along the member between the first and second ends of the member, to operate the image projector to form an image on the portion of the object, to operate the imaging device to generate the sequence of images of the image on the object, to receive a signal from the user interface indicating the position of the object for a printed image that has been selected for printing, to receive data from the user interface identifying a distortion of the image on the object, and to operate ejectors within the printheads of the plurality of printheads with reference to the data identifying the distortion of the image from the image projector to form an image with colorant on the object.

2. The printing system of claim 1 wherein the imaging device is a camera operatively connected to the user interface for delivery of a sequence of video images to the user interface.

3. The printing system of claim 2 wherein the image projector is a printhead in the plurality of printheads that is configured to eject infrared material onto the object to form the image on the object with the infrared material; and the camera is configured for infrared imaging.

4. The printing system of claim 3, the controller being further configured to operate the actuator to maintain the holder and the object opposite the camera to enable a portion of the object to be selected for the image, to operate the first actuator to move the selected portion of the object opposite the printhead ejecting infrared material, to operate the printhead to eject the infrared material onto the selected portion of the object, and to operate the first actuator to move the portion of the object opposite the imaging device to enable the sequence of images generated by the imaging device of the infrared material image to be sent to the user interface.

5. The printing system of claim 2 wherein the image projector is a light projector that is positioned to enable the light projector to direct a light image onto the object while the object is with a field of view of the camera.

6. The printing system of claim 2 further comprising:

an ultraviolet (UV) lamp configured to emit light in an UV range to cure UV curable marking material ejected from at least one of the printheads in the plurality of printheads; and the controller is operatively connected to the UV lamp, the controller being further configured to operate the UV lamp to cure UV ink ejected by at least one of the printheads onto the object.

7. The printing system of claim 1 wherein the user interface is configured to generate the data identifying the image distortion as data identifying the image distortion as one of a barrel distortion, a pin cushion distortion, a mustache distortion, and a keystone distortion.

8. The printing system of claim 1 further comprising:

a third actuator operatively connected to the holder, the actuator being configured to rotate the object about a Z axis extending between the imaging device and the object; and the user interface includes a control operatively connected to the third actuator to rotate the object about the Z axis.

9. A method for operating a printer comprising:

operating with a controller a first actuator operatively connected to a holder to move the holder and an object secured in the holder along a member to which the holder is mounted;

operating with the controller an imaging device to generate a sequence of images of the object in response to the object being opposite the imaging device;

displaying the sequence of images at a user interface;

operating with the user interface the first actuator to adjust a position of the object along a Y axis and operating with the user interface a second actuator to adjust a position of the object along a X-axis;

generating with the user interface a signal indicating a location on the object for an image that has been selected;

operating with the controller an image projector to place the image on the object;

generating with the user interface data for identifying a distortion of the image on the object; and operating with the controller ejectors within a plurality of printheads to form an image with colorants on the selected portion of the object with reference to the data identifying the distortion of the image while the controller is operating the first actuator to move the holder and the object past the plurality of printheads.

10. The method of claim 9, the operation of the imaging device further comprises:

generating a sequence of video images with a camera.

11. The method of claim 10, the operation of the image projector further comprises:

operating with the controller a printhead in the plurality of printheads that is configured to eject infrared material onto the object to form the image on the object with the infrared material before the image formed with marking material is formed.

12. The method of claim 11 further comprising:

operating the first actuator with the controller to maintain the holder and the object opposite the camera to enable a portion of the object to be selected for the image;

operating the first actuator to move the selected portion of the object opposite the printhead ejecting infrared material;

operating with the controller the printhead to eject the infrared material onto the selected portion of the object; and operating with the controller the first actuator to move the portion of the object opposite the imaging device to enable the sequence of images generated by the imaging device of the infrared material image to be sent to the user interface.

13. The method of claim 10, the operation of the image projector further comprises:

operating a light projector to direct a light image onto the object while the object is within a field of view of the camera.

14. The method of claim 10 further comprising:

operating with the controller an ultraviolet (UV) lamp configured to emit light in an UV range to cure UV curable marking material ejected from at least one of the printheads in the plurality of printheads.

15. The method of claim 9, the generation of the data identifying the image distortion further comprises:

generating with the user interface a code that identifies a barrel distortion, a pin cushion distortion, a mustache distortion, or a keystone distortion.

16. The method of claim 9 further comprising:

operating a third actuator with the user interface to rotate the object about a Z axis that extends between the imaging device and the object.

* * * * *